US005164015A

United States Patent [19]

Kuhnke et al.

[11] Patent Number: 5,164,015

[45] Date of Patent: Nov. 17, 1992

[54] METHOD FOR CLEANING A VESSEL

[75] Inventors: Klaus Kuhnke, Erlangen; Alexander Langner, Leipzig; Klaus Pflugbeil, Leipzig; Kurt Schindler, Leipzig; Dorothea Moldenhauer, Tharandt; Siegfried Köhler, Leipzig, all of Fed. Rep. of Germany

[73] Assignee: Siemens Aktiengesellschaft, Berlin and Munich, Fed. Rep. of Germany

[21] Appl. No.: 669,032

[22] Filed: Mar. 14, 1991

Related U.S. Application Data

[63] Continuation-in-part of Ser. No. 126,849, Nov. 30, 1987, abandoned.

[30] Foreign Application Priority Data

Dec. 1, 1986 [DE] Fed. Rep. of Germany ..... 3640428

[51] Int. Cl.[5] ..... B08B 3/00

[52] U.S. Cl. ..... 134/2; 134/3; 134/28; 134/41

[58] Field of Search ..... 134/2, 3, 28, 41

[56] References Cited

U.S. PATENT DOCUMENTS 3,627,687 12/1971 Teumac ..... 134/2

3,627,857 12/1971 Matuno ..... 134/2

FOREIGN PATENT DOCUMENTS 1062590 9/1979 Canada ..... 134/2

237095 7/1986 German Democratic Rep. .

2113254 8/1983 United Kingdom ..... 134/2

OTHER PUBLICATIONS

Publication "Steam Generator Chemical Cleaning Process Development", Final Report, Apr. 1983, pp. 4-1--4-3.

*Primary Examiner*—Asok Pal

*Attorney, Agent, or Firm*—Herbert L. Lerner; Laurence A. Greenberg

[57] ABSTRACT

A method for cleaning a vessel by dissolving iron oxide present in the vessel includes introducing a saline solution into the vessel, the saline solution being formed of an acid acting as a complexing agent, of an alkalizing agent and of a reducing agent, the saline solution acting as an alkaline reducer; retaining the saline solution in the vessel for a given period of time at a temperature above 140° C. and below the decomposition temperature of the anionic part of the saline solution for forming an iron complex; and subsequently removing the dissolved iron complex by emptying the vessel.

17 Claims, No Drawings

METHOD FOR CLEANING A VESSEL

CROSS-REFERENCE TO RELATED APPLICATION

This application is a continuation-in-part of application Ser. No. 126,849, filed Nov. 30, 1987, now abandoned.

The invention relates to a method for cleaning a vessel, especially a vessel of a steam generator in a nuclear power plant, in which iron oxide present in the vessel is dissolved.

In such heretofore known cleaning methods, complexing acids which are supplied to the vessel to be cleaned dissolve the deposited iron oxide by complexing. Prior art methods generally work in the acid or neutral range and at temperatures below 100° C.

Due to the acid cleaning solution used in conventional methods, the material of the vessel and especially the materials of the supply lines are subjected to a great hazard. This is because the acid attacks the metallic surfaces of the vessel and the lines. Furthermore, if the action takes place in the neutral range, only limited effectiveness is achieved with the conventional cleaning methods.

A prior art multi-stage method, the so-called Mark III method, is alternately used in the acid and the neutral range. This cleaning method is extensive and elaborate, and it takes a great deal of time and entails high cost.

It is an object of the invention to provide a method for removing corrosion products from a vessel, especially iron oxide in a steam generator, which overcomes the hereinafore-mentioned disadvantages of the heretofore-known methods of this general type and which minimizes attacks of cleaning chemicals on the materials of the vessel and the lines, while being highly effective and being able to be performed relatively quickly.

With the foregoing and other objects in view there is provided, in accordance with the invention, a method for cleaning a vessel by dissolving iron oxide present in the vessel, the method which comprises introducing a saline solution into the vessel, the saline solution being formed of an acid acting as a complexing agent, of an alkalizing agent and of a reducing agent, the saline solution acting as an alkaline reducer and having an anionic part; retaining the saline solution in the vessel for a given period of time at a temperature above 140° C. and below the decomposition temperature of the anionic part of the saline solution for forming an iron complex; and subsequently removing the dissolved iron complex by emptying the vessel.

Through the use of the method according to the invention, the iron complexing and thus the cleaning of the vessel is performed with great efficiency in the alkaline range. The anion in the saline solution thereby causes the formation of complexes. On the one hand, the alkalizing agent raises the pH value of the cleaning solution into the alkaline range and, on the other hand, the reducing agent causes reducing conditions in the steam generator. The reducing conditions in the steam generator are required, firstly in order to reduce trivalent iron to bivalent iron and, secondly, in order to reduce harmful actions of the cleaning solution on the metallic surfaces of the vessel. The desired complexing of the iron in the alkaline range is made possible by setting the temperature in the vessel to be cleaned in accordance with the invention to a value of above 140° C. and below the decomposition temperature of the anionic part of the saline solution acting as complexing agent.

Besides the temperature, the pH value of the cleaning solution is also of decisive importance for the optimum degree of cleaning. An overly low pH value would lead to a high removal of base metals of non-alloyed or low-alloyed materials in the vessel. An overly high pH value leads to a large decrease in the solubility of the iron.

Accordingly, in accordance with an added feature of the invention, the temperature of the saline solution during the formation of the iron complex is selected between substantially 140° C. and 220° C. and, in accordance with an additional feature of the invention, the saline solution is set to a pH value greater than substantially 9.6 by the addition of a volatile alkalizing agent prior to the step of introducing the saline solution into the vessel, and setting an optimum pH value substantially between 9.0 and 9.5 for cleaning in the vessel by partial evaporation of the volatile alkalizing agent at least as late as the step of introducing the saline solution.

This leads to an optimum cleaning result with a correspondingly low base metal removal of non-alloyed or low-alloy materials, particularly with pH value between 9.0 and 9.5. A suitable temperature range lies between 140° C. and 220° C. In a further embodiment of the invention, the saturation of the saline solution is awaited during the formation of the iron complex.

An advantage of the method according to the invention is the freeing of the vessel of iron oxide deposits with only one chemical in one step and with great effectiveness, without the surfaces of the vessel and the supply and removal lines being attacked and possibly damaged by acids. Conventional iron-containing vessels and the lines are not attacked by the alkaline reducing chemical solution. In comparison with the conventional prior art multi-stage method, the cleaning method of the invention can be performed up to forty times faster.

In accordance with yet a further feature of the invention, the saline solution is formed by introducing the acid into an aqueous solution of the alkalizing agent present in a reaction vessel while stirring and cooling the mixture from about 50°-60° C. to about ambient temperature at a rate of, for example, 20° C. per hour and, in accordance with yet an additional feature of the invention, subsequently introducing the reducing agent in the reaction vessel.

In accordance with yet another mode of the invention, there is provided a method which comprises selecting the acid acting as a complexing agent as nitrilotriacetic acid (NTA) or ethylene diamine tetraacetic acid (EDTA).

Suitable alkalizing agents are preferably selected from the group consisting of ammonia, ethylene diamine and morpholine, or a mixture of these substances.

In accordance with an added mode of the invention, there is provided a method which comprises selecting the reducing agent as hydrazine or ascorbic acid.

In accordance with again an added feature of the invention, the alkalizing agent may be selected from the group consisting of sodium hydroxide and potassium hydroxide and, in accordance with again an advantageous embodiment of the invention, the alkalizing agent is a volatile alkalizing agent.

In accordance with again an additional feature of the invention, the saline solution is advantageously formed of nitrilotriacedic acid (NTA), ammonia and hydrazine with the nitrilotriacedic acid forming the anion of such a saline solution.

In accordance with an additional mode of the invention, there is provided a method which comprises, prior to introduction in the vessel to be cleaned, setting the saline solution to a pH value above 9.6 by the addition of a volatile alkalizing agent, and subsequently introducing the solution into the vessel. After or during the introduction, the optimum pH value for cleaning the vessel, between 9.0 and 9.5, is set by partial evaporation of the, possibly volatile, alkalizing agent and of, possibly present, water. The pH value control already advantageously avoids complexing and thus removal in the normally very long supply line leading to the vessel, which, on the other hand, would have resulted in a reduced cleaning action in the vessel itself.

The pH value may be controlled by means of the composition of the introduced solution and by means of the length of the evaporation of the alkalizing agent. In accordance with yet another mode of the invention, there is provided a method which comprises partially evaporating the contents of the vessel and thus producing a homogenous mix of the contents in the vessel due to the boiling motion.

For example, a portion of the solution present in the vessel is evaporated on a limited time basis during the cleaning process which is typically two to three hours, and maximally twelve hours in duration. This creates a flow within the vessel which leads to an even better contact between the cleaning solution and the surfaces to be cleaned. The lowering of the pH value caused by evaporation is compensated for by the regular metering-in of the alkalizing agent, such as ammonia.

In accordance with yet a further mode of the invention, there is provided a method which comprises degassing the dissolved salt and mixing the dissolved salt with, for instance, substantially 0.1% to 5% hydrazine, and regularly metering-in hydrazine even during the cleaning for setting a concentration of hydrazine between 10 mg/kg and 500 mg/kg in the vessel. This is done so that reducing conditions are obtained during the entire duration of the cleaning.

After the iron oxide is dissolved, the vessel is emptied. In accordance with yet an added mode of the invention, there is provided a method which comprises evacuating the vessel with an inert gas, especially nitrogen or water vapor during emptying of the vessel. This avoids the entry of air during emptying. This also prevents the renewed formation of iron oxide because of the entry of atmospheric oxygen.

As long as any copper component of the residue in the vessel is less than 10%, the method according to the invention is not affected. Removal of the copper is then possible after the removal of the iron oxide in accordance with the invention.

In accordance with a concomitant and recommended mode of the invention, there is provided a method which comprises removing copper in the vessel before the dissolution of the iron oxide if a copper concentration of more than 10% is present in all of the deposits or residue in the vessel. The cleaning process described in Published European Application No. 01 98 340 is suitable for this purpose.

An advantage of the invention is that vessels, especially steam generators of a nuclear power plant, can be dependably freed of iron oxide deposits in a short period of time and with little cost, while the metallic surfaces are protected. Especially in connection with nuclear power plants, there is a particular advantage of the invention which is that a down time of only approximately twelve hours is required for a complete cleaning of a steam generator. Additionally, contaminants in the form of salts which are brought into the vessel during steady operation and are deposited there, are effectively removed by means of the method according to the invention. Furthermore, the protective method according to the invention precludes damage to non-alloyed or low-alloyed base metals due to corrosion.

After a cleaning run has been completed, it is not required that the cleaning solution be immediately removed or forcefully cooled in order to avoid corrosion of the vessel material. As a matter of fact, the solution which has been saturated by the iron oxide can be left in the vessel for a practically unlimited amount of time, which is an essential advantage for cleaning operations.

Other features which are considered as characteristic for the invention are set forth in the appended claims.

Although the invention is illustrated and described herein as embodied in a method for cleaning a vessel, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the description of specific embodiments given above.

We claim:

1. Method for cleaning a vessel by dissolving iron oxide present in the vessel, which comprises:

forming a saline solution of an acid acting as a complexing agent, of an alkalizing agent and of a reducing agent, the saline solution acting as an alkaline reducer and having an anionic part;

introducing the saline solution into the vessel;

setting the saline solution to a pH value greater than substantially 9.6 by the addition of a volatile alkalizing agent prior to the step of introducing the saline solution into the vessel, and setting an optimum pH value substantially between 9.0 and 9.5 for cleaning in the vessel by partial evaporation of the volatile alkalizing agent at least as late as the step of introducing the saline solution;

retaining the saline solution in the vessel for given period of time for forming an iron complex; and subsequently removing the dissolved iron complex by emptying the vessel.

2. Method according to claim 1, which comprises selecting the temperature of the saline solution during the formation of the iron complex between substantially 140° C. and 220° C.

3. Method according to claim 1, which comprises awaiting the saturation of the saline solution during the formation of the iron complex.

4. Method according to claim 1, which comprises a step of forming the saline solution by introducing an aqueous solution of the alkalizing agent into a reaction vessel; and introducing the acid into the aqueous solution while stirring and cooling.

5. Method according to claim 4, wherein the step of forming the saline solution further comprises:

subsequently introducing the reducing agent into the reaction vessel.

6. Method according to claim 1, which comprises selecting the acid acting as a complexing agent from the group consisting of ethylene diamine tetraacetic acid and nitrilotriacetic acid.

7. Method according to claim 1, which comprises selecting the alkalizing agent as at least one substance from the group consisting of ammonia, ethylene diamine and morpholine.

8. Method according to claim 1, which comprises selecting the alkalizing agent from the group consisting of sodium hydroxide and potassium hydroxide.

9. Method according to claim 1, which comprises selecting a volatile alkalizing agent.

10. Method according to claim 1, which comprises selecting the reducing agent from the group consisting of hydrazine and ascorbic acid.

11. The method according to claim 1, which comprises retaining the saline solution in the vessel at a temperature above 140° C. and below the decomposition temperature of the anionic part of the saline solution in the retaining step.

12. Method according to claim 1, which comprises evaporating the contents of the vessel prior to removing them for causing a homogenous thorough mix of the contents of the vessel due to boiling motion.

13. Method according to claim 1, which comprises degassing the saline solution and mixing the saline solution with substantially 0.1% to 5% hydrazine before the step of introducing the saline solution into the vessel, and regularly metering-in hydrazine during the given period of time for setting a concentration of hydrazine between 10 mg/kg and 500 mg/kg in the vessel.

14. Method according to claim 1, which comprises applying pressure on the vessel with an inert gas during the step of emptying the vessel.

15. Method according to claim 14, which comprises selecting the inert gas from the group consisting of nitrogen and water vapor.

16. Method according to claim 1, which comprises removing copper in the vessel before the complexing of the iron oxide if a copper concentration of more than 10% of all deposits in the vessel is present.

17. Method according to claim 1, which comprises selecting a saline solution formed of nitrilotriacedic acid (NTA), ammonium and hydrazine, the nitrilotriacedic acid forming the anion of the saline solution.

* * * * *